US010584430B2

(12) United States Patent
Hahm et al.

(10) Patent No.: US 10,584,430 B2
(45) Date of Patent: Mar. 10, 2020

(54) SECURITY YARN CONTAINING MULTI-COMPONENT SPINNING FIBER AND SECURITY PRODUCT USING THE SAME

(71) Applicant: KOREA INSTITUTE OF INDUSTRIAL TECHNOLOGY, Chungcheongnam-do (KR)

(72) Inventors: Wan-Gyu Hahm, Gyeonggi-do (KR); Sung Won Byun, Seoul (KR); Byeong Jin Yeang, Suwon-si (KR); In Woo Nam, Seoul (KR); Seung Jin Lee, Seoul (KR); Do Gun Kim, Gyeonggi-do (KR); Ki Sub Lim, Incheon (KR)

(73) Assignee: Korea Institute of Industrial Technology, Chungcheongnam-Do (KR)

( * ) Notice: Subject to any disclaimer, the term of this patent is extended or adjusted under 35 U.S.C. 154(b) by 578 days.

(21) Appl. No.: 14/443,581

(22) PCT Filed: Oct. 15, 2013

(86) PCT No.: PCT/KR2013/009190
§ 371 (c)(1),
(2) Date: May 18, 2015

(87) PCT Pub. No.: WO2014/061958
PCT Pub. Date: Apr. 24, 2014

(65) Prior Publication Data

US 2015/0329996 A1 Nov. 19, 2015

(30) Foreign Application Priority Data

Oct. 15, 2012 (KR) ..... 10-2012-0114108

(51) Int. Cl.
*D02G 3/44* (2006.01)
*D01F 8/12* (2006.01)
(Continued)

(52) U.S. Cl.
CPC ..... *D02G 3/44* (2013.01); *B42D 25/355* (2014.10); *B42D 25/36* (2014.10); *D01D 5/253* (2013.01);
(Continued)

(58) Field of Classification Search
CPC ..... D02G 3/44; B42D 25/355; B42D 25/387; B42D 25/382; B42D 25/36;
(Continued)

(56) References Cited

U.S. PATENT DOCUMENTS 3,963,678 A * 6/1976 Conrad ..... B60C 9/0042 264/178 F
4,655,788 A 4/1987 Jalon
(Continued)

FOREIGN PATENT DOCUMENTS

JP 2582177 B2 * 2/1997
KR 19960013836 B1 10/1996
(Continued)

OTHER PUBLICATIONS

"KR20110035139_Machine Translation" is a machine translation of KR 2011/0035139.*
(Continued)

*Primary Examiner* — Laura C Powers
*Assistant Examiner* — Larissa Rowe Emrich
(74) *Attorney, Agent, or Firm* — Levenfeld Pearlstein, LLC

(57) ABSTRACT

The present invention discloses a security yarn containing a multi-composite spinning fiber and security products using the same. The multi-composite spinning fiber, according to the present invention, contains, in at least one or more kinds of polymer materials, a first component selected from an IR reactive pigment or an IR absorption pigment, a second component selected from a visible pigment or an invisible
(Continued)

UV-reactive fluorescent pigment, and a third component selected from X-ray absorption materials, so that the security yarn containing the multi-component spinning fiber can be identified by infrared and ultraviolet wavelength and easily identified when irradiated with X-rays, thus providing a multi-identification capability and being useful for preventing counterfeiting. Therefore, the security yarn containing a multi-composite spinning fiber can be useful for preventing the counterfeiting of paper money, gift certificates, marketable securities, and passports or the like, preventing imitations of expensive brand-name products, or identifying a friend or a foe for military purposes.

11 Claims, 3 Drawing Sheets

(51) Int. Cl.

| | |
|---|---|
| ***B42D 25/355*** | (2014.01) |
| ***B42D 25/36*** | (2014.01) |
| ***D21H 21/44*** | (2006.01) |
| ***D01F 1/04*** | (2006.01) |
| ***D01D 5/30*** | (2006.01) |
| ***D01F 1/10*** | (2006.01) |
| ***D01D 5/253*** | (2006.01) |
| ***D01F 8/06*** | (2006.01) |
| ***D01F 8/14*** | (2006.01) |

(52) U.S. Cl.
CPC ..... *D01D 5/30* (2013.01); *D01F 1/04* (2013.01); *D01F 1/106* (2013.01); *D01F 8/12* (2013.01); *D21H 21/44* (2013.01); *D01F 8/06* (2013.01); *D01F 8/14* (2013.01); *D10B 2321/022* (2013.01); *D10B 2331/02* (2013.01); *D10B 2331/04* (2013.01); *Y10T 428/1334* (2015.01); *Y10T 428/249921* (2015.04); *Y10T 428/2929* (2015.01); *Y10T 428/2931* (2015.01)

(58) Field of Classification Search
CPC .. B42D 25/00–391; B42D 2033/00–32; D01D 5/253; D01D 5/32; D01D 5/34; D01D 5/30–36; D01F 1/04; D01F 1/106; D01F 8/12; D01F 8/06; D01F 8/14; D01F 1/10–106; D01F 8/04–16; D21H 21/44; D21H 21/48; Y10T 428/2929; Y10T 428/2931; Y10T 428/2927–2931; Y10T 428/2964–2969; Y10T 428/2973; Y10T 428/32; D10B 2321/022; D10B 2331/02; D10B 2331/04; D10B 2401/022
USPC ..... 428/372–374, 392–395, 397, 688–690, 428/692.1
See application file for complete search history.

(56) References Cited

U.S. PATENT DOCUMENTS

| | | | | |
|---|---|---|---|---|
| 4,756,557 | A * | 7/1988 | Kaule | D21H 21/48 283/85 |
| 5,183,614 | A * | 2/1993 | Champion | D01F 1/106 264/184 |
| 2009/0311527 | A1 * | 12/2009 | Seo | D01D 5/32 428/374 |

FOREIGN PATENT DOCUMENTS

| | | | |
|---|---|---|---|
| KR | 10259825 | B1 | 6/2000 |
| KR | 20020046382 | B1 | 6/2002 |
| KR | 20010056975 | A | 7/2002 |
| KR | 100374293 | B1 | 3/2003 |
| KR | 20110035139 | A * | 4/2011 |
| KR | 1020110035139 | A | 4/2011 |
| KR | 1020120052722 | A | 5/2012 |
| KR | 101198679 | A | 11/2012 |
| KR | 1020130029907 | A | 3/2013 |

OTHER PUBLICATIONS

"JP2582177_Machine Translation" is a mchine translation of JP 2582177.*
"1020110035139KRA.TRANS" is a translation of KR 2011-0035139. (Year: 2011).*
International Search Report for PCT/KR2013/009190 dated Nov. 26, 2013.

* cited by examiner

SECURITY YARN CONTAINING MULTI-COMPONENT SPINNING FIBER AND SECURITY PRODUCT USING THE SAME

CROSS-REFERENCE TO RELATED APPLICATIONS

This is a National Stage Application of International Patent Application No. PCT/KR2013/009190, filed. Oct. 15, 2013, which claims the benefit of and priority to Korean Patent Application No, 10-2012-0114108, Oct. 15, 2012, the contents of which are incorporated fully by reference herein.

TECHNICAL FIELD

The present invention relates to security yarn containing a multi-component spinning fiber and a security product using the same, and more particularly, to security yarn containing a multi-component spinning fiber and a security product using the same wherein the multi-component spinning fiber contains, in at least one or more kinds of polymer materials, a first component selected from an IR reactive pigment or an IR absorption pigment, a second component selected from a visible pigment or an invisible UV-reactive fluorescent pigment, and a third component selected from X-ray absorption materials, so that the security yarn containing the multi-component spinning fiber can be identified by infrared and ultraviolet wavelength and easily identified when irradiated with X-rays, thus providing a multi-identification capability.

BACKGROUND ART

Generally, a melt conjugated spinning apparatus is a spinning machine wherein different kinds of polymer materials are introduced into two or more melt extruders, melted with heat and pressure, and added in a pack having a plurality of distribution plates and nozzles to a desired fiber section and shape.

The fiber made by the melt conjugated spinning apparatus is called a conjugated fiber, and since the conjugated fiber is made through the conjugated spinning with different kinds of polymer materials, the conjugated fiber has core-sheath type, side-by-side type, and sea-island type cross sections.

Further, fibers having different physical properties (strength and elongation), thicknesses and sectional shapes (circular, +, Y, −, and hollow shapes) are made of the same kind or different kinds of polymer materials through the melt conjugated spinning apparatus, and next, the fibers are added in post process. In this case, the fibers are called blended yarn (blended fibers).

In case of the blended yarn, different fibers are made individually, and they are then added to each other in the post process, thus undesirably making the manufacturing process complicated, decreasing the productivity, and increasing the manufacturing cost. Above all, the conventional melt conjugated spinning apparatus does not manufacture the multiple conjugated yarn made of three or more kinds of polymer materials, thus undesirably causing various functions and properties of the polymer materials to be restrictedly expressed.

Accordingly, Korean Patent Application Laid-Open No. 2012-52722 as filed by the same inventors as the invention discloses a multiple fiber spinning apparatus wherein multiple kinds of polymer materials are spun at the same time to manufacture the fiber yarn having various internal structures. As a result, the multiple kinds of polymer materials are spun at the same time from the apparatus, thus obtaining the multiple composite or blended fiber having various functions and performance.

Generally, paper used as sheets for bank money, check, passports, bonds, marketable securities and so on requiring security makes use of fluorescent yarn having counterfeit prevention effects, visual effects, and authenticity identification effects, and accordingly, the fluorescent yarn as synthetic fibers added to the paper to a small number is called security yarn.

Generally, staple fibers having 3 to 10 mm are partially colored or fluorescent, and next, they are added during a paper making process of perfect stuff to provide visually different colors or a fluorescent color under ultraviolet rays, thus making a difference from general paper.

Objects of recent security elements are to provide an identification capability by naked eyes and to provide an authentication capability through an identifier. That is, it is necessary to perform rapid and clear authentication through machines because of deposit and withdrawal of marketable securities by automated teller machines, the use in automatic vending machines, and the distribution of various security products.

Conventional fluorescent yarn is disclosed in Korean Patent No. 346056, wherein the fluorescent yarn has a single color made by mixing a fluorescent pigment with a synthetic resin and by melt spinning the mixed material. Another fluorescent yarn used for a security film is disclosed in Korean Patent No. 374293, wherein red, blue and green fluorescent pigments are dyed with nylon yarn by color to make fluorescent yarn having a single color like red, blue and green expressed on each strand, and next, the fluorescent yarn having different colors is mixed. However, the conventional fluorescent yarn has a simple color or structure and a low degree of uniformity in color upon dyeing, thus exhibiting a bad counterfeit prevention capability.

So as to remove the above-mentioned problems, there have been various technologies for the visual effects of the fluorescent yarn, and one of the conventional technologies is disclosed in Korean Patent Gazette No. 1996-1336 wherein there is provided a method for manufacturing a fiber having different colors or multiple colors dyed with two or more pigments thereon. That is, the fiber is primarily dyed, while portions of the fiber spaced apart from each other by given distances are being shielded, and then, the fiber is dried. Next, the shielded portions are open, while the dyed portions are being shielded, and they are dyed with different color from the primarily dyed color. Further, Korean Patent No. 259825 discloses a method for manufacturing a multi-colored fiber wherein a plurality of fibers is dyed on the exposed portion thereof in the state of being twisted, and next, after the fibers are cut and untwisted from the twisted state, the portions not exposed to the outside are dyed with different colors from the colors first dyed. According to the conventional methods, however, the dyeing process becomes complicated, and it is hard to manufacture the fluorescent yarn in large quantities. Further, the boundary surface between the dyed portions is not uniform, and the dyeing is conducted on the surface of the fiber, thus making the durability deteriorated.

On the other hand, U.S. Pat. No. 4,655,788 discloses a method for manufacturing fluorescent yarn having fluorescent material excited on infrared rays, visible light, and ultraviolet rays, wherein two materials excited on different light sources are provided to reduce the possibility of counterfeit.

Accordingly, the present inventors have made various studies to solve the above problems and as a result, they have found that if a multi-component spinning fiber is applied to security yarn and components identified by wavelength are contained in at least one or more kinds of polymer materials, a multi-identification capability can be provided. It has been further found that if the whole specific gravity of the security yarn containing the multi-component spinning fiber satisfies more than 1, the security yarn is submerged upon a paper making process, thus increasing the contents thereof, and if a hydrophilic polymer material is located as an outer component of the multi-component spinning fiber, the dispersion rate in water of the security yarn is improved and the mixing with perfect stuff is advantageously conducted during the paper making process, thus enhancing the identification efficiencies of security products using the security yarn providing the multi-identification capability.

DISCLOSURE

Technical Problem

Accordingly, the present invention has been made in view of the above-mentioned problems occurring in the prior art, and it is an object of the present invention to provide security yarn containing a multi-component spinning fiber that is capable of providing a multi-identification capability.

It is an object of the present invention to provide a security product using security yarn containing a multi-component spinning fiber that is capable of providing a multi-identification capability.

Technical Solution

To accomplish the above-mentioned objects, according to a first aspect of the present invention, there is provided security yarn containing a multi-component spinning fiber, wherein the multi-component spinning fiber has a first component selected from an IR reactive pigment or an IR absorption pigment, a second component selected from a visible pigment or an invisible UV-reactive fluorescent pigment, and a third component selected from X-ray absorption materials, the first component, the second component and the third component being contained in at least one or more kinds of polymer materials.

According to the present invention, preferably, each polymer material of the multi-component spinning fiber has a circular cross section or has any one modified cross section selected from the group consisting of triangular, rectangular, polygonal, oval, – shaped, Y shaped, + shaped, # shaped and * shaped cross sections.

According to the present invention, preferably, the multi-component spinning fiber is any one selected from the group consisting of core-sheath type, sea-island type and side-by-side type fibers.

According to the present invention, preferably, 0.001 to 50% by weight of the first component selected from the IR reactive pigment and the IR absorption pigment is contained in any one of the polymer materials.

According to the present invention, preferably, 0.001 to 50% by weight of the second component selected from the visible pigment and the invisible UV-reactive fluorescent pigment is contained in any one of the polymer materials, and 0.001 to 100% by weight of the third component selected from the X-ray absorption materials is contained in any one of the polymer materials.

According to the present invention, preferably, the third component is formed of a material, having an X-ray shielding function and satisfying a specific gravity in the form of powder of 1 or more at a room temperature or 300° C.

According to the present invention, preferably, the multi-component spinning fiber has the specific gravity of 1 or more.

According to the present invention, preferably, the multi-component spinning fiber has any one component having at least one hydrophilic polymer resin selected from the group consisting of nylon, polyacrylonitrile, polyacrylic acid, polyacrylate, polymethyl methacrylate, polyethylene amide, cellulos acetate, cellulose triacetate, polyvinyl alcohol, polyvinylpyrrolidone, polyethylene glycol, sulfonated polysulfone, polyethylene oxide and polyvinyl acetate or at least one polyester resin selected from the group consisting of polyethylene terephthalate, polybutylene terephthalate, polytrimethylene terephthalate and polyethylene naphthalate.

According to the present invention, preferably, any one component is an outer component constituting the multi-component spinning fiber.

According to the present invention, preferably, the multi-component spinning fiber has any other component selected from the group consisting of polypropylene, polyethylene, polyethylene terephthalate, polyethylene naphthalate, polystyrene, polycarbonate, polymethyl methacrylate, polyether sulfone, polyvinylidene fluoride, polyether ketone, polyphenylene sulfide and aromatic polyester.

According to the present invention, preferably, the thickness of a single filament of the multi-component spinning fiber is more than 1000 denier.

To accomplish the above-mentioned objects, according to a second aspect of the present invention, there is provided a counterfeit money prevention product applied to any one of paper money, gift certificates, marketable securities, and passports processed mixedly with security yarn containing a multi-component spinning fiber according to the first aspect of the present invention, through a paper making process.

To accomplish the above-mentioned objects, according to a third aspect of the present invention, there is provided an imitation prevention product applied to any one of bags, shoes and clothes including security yarn containing a multi-component spinning fiber according to the first aspect of the present invention or a military identification friend or foe product applied to any one of military products including security yarn containing a multi-component spinning fiber according to the first aspect of the present invention.

Advantageous Effects

According to the present invention, the security yarn containing the multi-component spinning fiber can be identified by infrared and ultraviolet wavelength and also identified by X-ray irradiation. Accordingly, the security yarn has means capable of providing a multi-identification capability, thus being useful for preventing counterfeiting.

Furthermore, the specific gravity of the security yarn containing the multi-component spinning fiber according to the present invention satisfies more than 1, so that the security yarn is submerged upon a paper making process, thus increasing the contents thereof, and especially, the hydrophilic polymer material is located at the outside of the multi-component spinning fiber, so that the dispersion rate in water is improved upon the paper making process and the mixing is advantageously conducted during the paper making process, thus allowing the security yarn to be applied to a counterfeit money prevention product applied to any one of paper money, gift certificates, marketable securities, and passports.

In addition, the security yarn containing the multi-component spinning fiber can be identified by infrared and ultraviolet wavelength and also identified by X-ray irradiation, thus being applied to an imitation prevention product such as expensive brand-name bags, shoes and clothes or to a military identification friend or foe product.

BEST MODE FOR INVENTION

Figure 1:
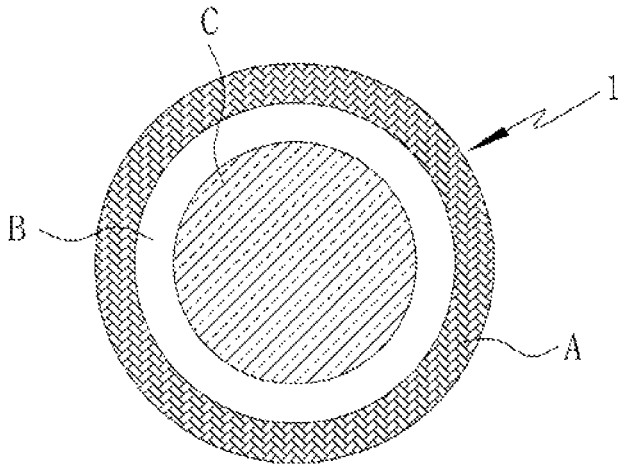
FIG. 1 is a sectional view showing a core-sheath type multi-component spinning fiber constituting security yarn according to the present invention.

Hereinafter, an explanation on security yarn containing a multi-component spinning fiber and a security product using the same according to the present invention will be in detail given with reference to the attached drawings.

According to the present invention, there is provided security yarn containing a multi-component spinning fiber, wherein the multi-component spinning fiber has a first component selected from an IR reactive pigment or an IR absorption pigment, a second component selected from a visible pigment or an invisible UV-reactive fluorescent pigment, and a third component selected from X-ray absorption materials, the first component, the second component and the third component being contained in at least one or more kinds of polymer materials.

According to the present invention, the multi-component spinning fiber has three different functional materials (IR, UV, and X-ray) contained at the same time in the at least one or more kinds of polymer materials.

At this time, the polymer materials contain their respective functional materials in such a manner as to be distinguished on the cross section of the fiber. For example, the three different functional materials are contained in three or more kinds of polymer materials (A, B, C, . . . ). At this time, at least three or more kinds of polymer materials (A, B, C, . . . ) are obtained through the control of a single spinning nozzle connected to at least three or more kinds of gear pumps, thus having at least three or more fiber cross sections.

Accordingly, the multi-component spinning fiber has three different functional materials (IR, UV, and X-ray), and in this case, the polymer materials having the same components as each other are repeatedly arranged on the boundary of one component. If two-component polymer materials are used, the functional materials may be mixed with any one polymer material.

According to the present invention, preferably, each polymer material of the multi-component spinning fiber has a circular cross section or has any one modified cross section selected from the group consisting of triangular, rectangular, polygonal, oval, – shaped, Y shaped, + shaped, # shaped and * shaped cross sections. In more detail, the multi-component spinning fiber is any one selected from the group consisting of core-sheath type, sea-island type and side-by-side type fibers.

According to the present invention, the security yarn has the multi-component spinning fiber, wherein the multi-component spinning fiber has the first component selected from the IR reactive pigment or the IR absorption pigment, the second component selected from the visible pigment or the invisible UV-reactive fluorescent pigment, and the third component selected from the X-ray absorption materials contained in any one of a plurality of kinds of polymer materials, so that the security yarn can be identified by infrared and ultraviolet wavelength and also identified by X-ray irradiation conducted typically on airports or public institutes.

At this time, 0.001 to 50% by weight of the first component selected from the IR reactive pigment or the IR absorption pigment or 0.001 to 50% by weight of the second component selected from the visible pigment or the invisible UV-reactive fluorescent pigment is contained in any one of the polymer materials. In this case, if less than 0.001% by weight of the first component or the second component is contained therein, the contents of the invisible UV-reactive fluorescent pigment are decreased, so that the colors of final fluorescent yarn are not discriminated well upon UV irradiation. To the contrary, if exceed 50% by weight of the first component or the second component is contained therein, mixing with the polymer resin is not conducted well, thus failing to perform uniform distribution and causing bad efficiencies even in high contents.

The IR reactive pigment of the first component is an IR sensitized pigment which is not visible in the visible light region but emits light when it is irradiated with light source of infrared rays (940 to 1,060 nm). At this time, the portion irradiated with the infrared rays emits light with green (530 to 560 nm), red (610 to 630 nm), or blue (430 to 470 nm). The IR reactive pigment is made in a laboratory or selected from commercial products.

Further, the IR absorption pigment of the first component includes various kinds of pigments such as naphthalocyanine compound, azo compound, phthalocyanine compound, dithiol-metal compound, diimonium compound, polymethine compound and anthraquinone compound, and accordingly, the IR absorption pigment can be freely selected from the known the IR absorption pigment compounds or commercial pigment products according to desired colors.

The invisible UV-reactive fluorescent pigment of the second component is a colored or colorless invisible TV-reactive fluorescent pigment which does not express any color in visible light but expresses given color when it is irradiated with ultraviolet rays. At this time, red, yellow-green, blue, and rainbow colors are expressed by ultraviolet wavelength, and the invisible UV-reactive fluorescent pigment is freely selected from the known the invisible UV-reactive fluorescent pigments. The invisible V-reactive fluorescent pigment is made in a laboratory or used with a commercial product.

Furthermore, the X-ray absorption material of the third component should have high X-ray absorption or shielding performance. At this time, the X-ray shielding means that atoms constituting a substance and X-rays are absorbed through interaction such as photoelectric effects, electron pair production, and compton scattering to lose their energy. Preferably, the X-ray absorption material is in the form of powder at a room temperature or at a high temperature of 300° C. or more and satisfies a specific gravity of 1 or more.

According to the present invention, more preferably, barium sulfate is adopted as a barium component satisfying a specific gravity of 1 or more, and also, ytterbium fluoride, YbF3 compound can be used as an X-ray absorption material. Additionally, YbF3 compound may be replaced with iodine, tungsten, and lead that are well known as materials having X-ray absorbing or shielding capability.

At this time, 0.001 to 100% by weight of the third component is desirably contained in any one of the polymer materials. Since the X-ray absorption material used in the present invention is a heavy metal having the specific gravity of 1 or more, the weight ratio of the third component is determined together with the consideration of a volume ratio thereof. Accordingly, 100% by weight of the third component does not mean that only the X-ray absorption material is contained in the polymer material, but means that the X-ray absorption material is contained in the polymer material to a maximum degree so as to raise an X-ray absorption rate.

Hereinafter, the polymer materials having the first component, the second component and the third component will be explained.

According to the present invention, the multi-component spinning fiber has three different materials arranged thereon so as to have at least three cross sections, and otherwise, the same components as each other are repeatedly arranged on the boundary of one component. In more detail, the polymer materials A-B-C constitute the multi-component spinning fiber, and otherwise, the polymer materials A-B-A constitute the multi-component spinning fiber.

According to the present invention, the multi-component spinning fiber has any one component having at least one hydrophilic polymer resin selected from the group consisting of nylon, polyacrylonitrile, polyacrylic acid, polyacrylate, polymethyl methacrylate, polyethylene amide, cellulos acetate, cellulose triacetate, polyvinyl alcohol, polyvinylpyrrolidone, polyethylene glycol, sulfonated polysulfone, polyethylene oxide and polyvinyl acetate or at least one polyester resin selected from the group consisting of polyethylene terephthalate, polybutylene terephthalate, polytrimethylene terephthalate and polyethylene naphthalate. At this time, the hydrophilic polymer resin or the polyester resin is formed as the outer polymer material. A of the multi-component spinning fiber.

According to the present invention, the multi-component spinning fiber has other component (B or C) selected from the group consisting of polypropylene, polyethylene, polyethylene terephthalate, polyethylene naphthalate, polystyrene, polycarbonate, polymethyl methacrylate, polyether sulfone, polyvinylidene fluoride, polyether ketone, polyphenylene sulfide and aromatic polyester, wherein the component (B or C) is made of a material having an excellent spinning capability.

Particularly, the specific gravity of the multi-component spinning fiber is controlled to satisfy 1 or more, and the control is achieved according to one polymer material A or another polymer material (B or C).

For example, since the specific gravity of polypropylene PP) and polyethylene (PE) used as the components located at the core side of the fiber is less than 1, the weight ratio of the hydrophilic polymer resin formed as the outer polymer material of the fiber should be controlled to allow the specific gravity of the multi-component spinning fiber to be more than 1.

So as to increase the specific gravity of the solid of the fiber, a degree of crystallization of the fiber is increased. In this case, the increment of the degree of crystallization of the fiber can be achieved with means capable of raising a heating temperature of the fiber or extending heating time of the fiber upon drawing or post-processing. Otherwise, strain-induced crystallization is produced in the fiber through high speed spinning.

For example, the specific gravity of the PET fiber having a non-crystalline structure is about 1.36, but that of the same PET fiber having a crystalline structure in which a degree of crystallization is high is raised up to about 1.45.

Accordingly, the specific gravity of the multi-component spinning fiber satisfies at least 1 or more, and since the multi-component spinning fiber is heavier than water, it is submerged during a paper making process, thus increasing the contents of the security yarn added to perfect stuff. Further, the hydrophilic polymer resin is formed as the outer polymer material of the multi-component spinning fiber, so that the dispersion rate in water of the security yarn can be improved upon the paper making process, thus allowing the security yarn to be easily mixed with the perfect stuff.

FIG. 1 is a sectional view showing a core-sheath type multi-component spinning fiber constituting security yarn according to the present invention, wherein the multi-component spinning fiber (1) has a core-sheath type cross section having three kinds of polymer materials A, B and C.

According to the present invention, preferably, nylon-polyethylene terephthalate-polypropylene (A-B-C) are arranged in the order from the outside to the core of the core-sheath type fiber, and the first component, the second component, and the third component are contained in the respective polymer materials. In this case, the polymer materials in which the components are contained or the positions of the polymer materials on the cross section are not limited specially.

Figure 2:
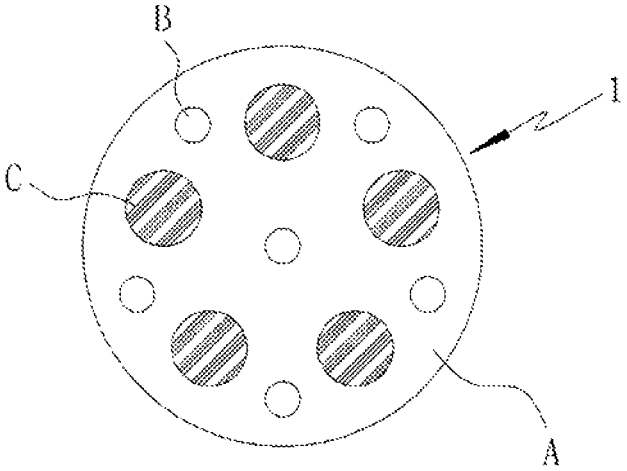
FIG. 2 is a sectional view showing a sea-island type multi-component spinning fiber constituting the security yarn according to the present invention.

FIG. 2 is a sectional view showing a sea-island type multi-component spinning fiber constituting the security yarn according to the present invention, wherein the multi-component spinning fiber (1) has a sea-island type cross section having three kinds of plurality of polymer materials A, B and C arranged with regular patterns.

According to the present invention, preferably, the sea-island type fiber has more than 10 island components made of a thermoplastic polymer resin material having a diameter of 10 μm or less, and more preferably, the sea-island type fiber has more than 30 island components made of a thermoplastic polymer resin material having a diameter of 1 μm or less.

At this time, nylon A is located as a sea component on the sea-island type fiber, and polymer materials B and C are located individually as island components on the sea-island type fiber.

Figure 3:
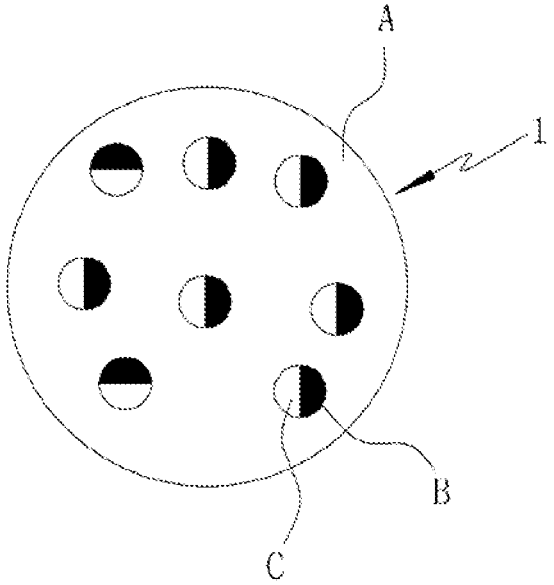
FIG. 3 is a sectional view showing other sea-island type multi-component spinning fiber constituting the security yarn according to the present invention.

FIG. 3 is a sectional view showing another sea-island type multi-component spinning fiber constituting the security yarn according to the present invention, wherein polymer materials B and C are located dividedly as island components on the sea-island type fiber, thus providing the sea-island type multi-component spinning fiber having the side-by-side type island components.

Figure 4:
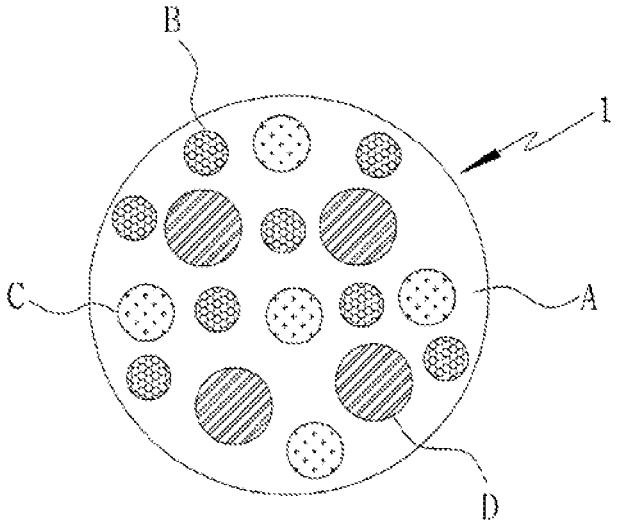
FIG. 4 is a sectional view showing other sea-island type multi-component spinning fiber constituting the security yarn according to the present invention.

FIG. 4 is a sectional view showing another sea-island type multi-component spinning fiber constituting the security yarn according to the present invention, wherein four kinds of polymer materials A, B, C and D are formed. In this case, if the hydrophilic polymer resin A is disposed as a sea component, three kinds of polymer materials B, C and D have independent or side-by-side type island components.

Figure 5:
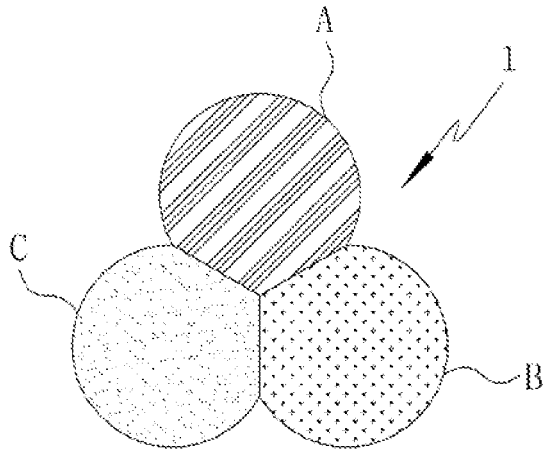
FIG. 5 is a sectional view showing a side-by-side type multi-component spinning fiber constituting the security yarn according to the present invention.

FIG. 5 is a sectional view showing a side-by-side type multi-component spinning fiber constituting the security yarn according to the present invention, wherein three kinds of polymer materials A, B and C are disposed side by side around the center of the multi-component spinning fiber, and the polymer materials A, B and C are disposed independently of each other.

Figure 6:
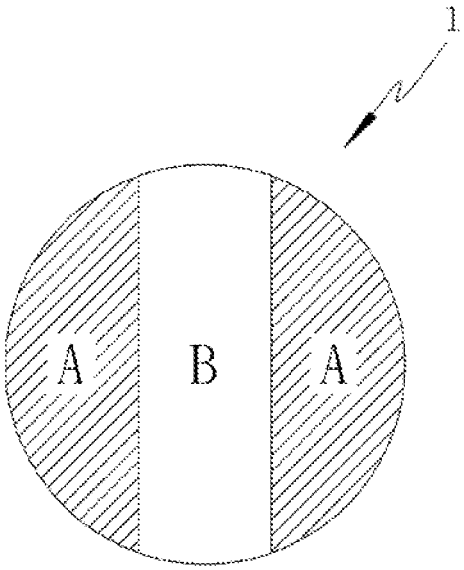
FIG. 6 is a sectional, view showing other side-by-side type multi-component spinning fiber constituting the security yarn according to the present invention.

On the contrary, FIG. 6 is a sectional view showing another side-by-side type multi-component spinning fiber constituting the security yarn according to the present invention, wherein two kinds of polymer materials A, B and A are disposed side by side in the shape of '–'.

According to the present invention, the multi-component spinning fiber is produced as a long filament fiber through high speed melt conjugated spinning. The long filament fiber is not produced through conventional electro-spinning, and further, the filament type multi-component spinning fiber has an excellent texture and is easy in the control of the structure thereof.

Further, the thickness of the multi-component spinning fiber is preferably 1000 denier or less, and more preferably 100 denier or less.

Furthermore, the security yarn containing the multi-component spinning fiber according to the present invention can be identified by infrared and ultraviolet wavelength and easily identified upon X-ray irradiation. Accordingly, the security yarn has means capable of providing a multi-identification capability, thus being useful for preventing counterfeiting.

Particularly, if the multi-component spinning fiber according to the present invention is made through the melt conjugated spinning, the specific gravity of the fiber satisfies more than 1, and the polymer material. A located at the outside of the multi-component spinning fiber is made of a hydrophilic polymer resin or a polyester resin having the intermediate polarity between hydrophile and hydrophobe, so that the multi-component spinning fiber is advantageous to a paper making process.

In detail, the security yarn containing the multi-component spinning fiber according to the present invention is submerged when mixed upon the paper making process, thus increasing the contents thereof, and especially, the polymer material A located at the outside of the multi-component spinning fiber is made of a hydrophilic polymer resin, so that the dispersion rate in water can be improved upon the paper making process and further, even when the security yarn is used with a relatively small quantity, a degree of identification can be increased.

According to the present invention, there is provided a counterfeit money prevention product applied to any one of paper money, gift certificates, marketable securities, and passports, with which the security yarn containing the multi-component spinning fiber according to the present invention is mixed through a paper making process.

Further, the security yarn containing the multi-component spinning fiber according to the present invention can be identified by infrared and ultraviolet wavelength, and particularly, the security yarn can be identified easily through X-ray irradiation conducted typically on airports or public institutes, so that the security yarn can be applied to an imitation prevention product such as expensive brand-name bags, shoes and clothes.

Furthermore, the security yarn containing the multi-component spinning fiber according to the present invention can be identified by infrared and ultraviolet wavelength, and particularly, authenticity identification can be achieved through the X-ray irradiation onto the security yarn, so that the security yarn can be applied to military products as identification friend or foe products.

Like this, as the security yarn containing the multi-component spinning fiber according to the present invention is contained in the products, the products can be easily identified, and since the security yarn as the form of fiber is applied to the products, it is easy to apply the security yarn to the processes for making the products.

Moreover, as the security yarn containing the multi-component spinning fiber according to the present invention is contained in the products, the products can be easily identified by wavelength or through equipment, and since the security yarn as the form of fiber is applied to the products, it is easy to apply the security yarn to the processes for making the products.

At this time, the security yarn containing the multi-component spinning fiber according to the present invention has physical properties having a strength of 2.5 g/den or more and elongation of 100% or less, so that it can be applied through sewing or weaving.

[Mode For Invention]

Hereinafter, the present invention will be in detail described with reference to Examples.

Examples are intended to describe the present invention more specifically, and the scope of the present invention is not intended to be limited to the Examples.

EXAMPLE 1

Manufacturing Core-sheath Type Multi-component Spinning Fiber

First, 20% by weight of barium sulfate was introduced into a polypropylene (PP) resin, and the compound was melted at 220° C. through a twin-extruder to form a master batch (M/B) chip (component C).

Next, 4% by weight of UV fluorescent yellow-green pigment was introduced into a polyethylene terephthalate (PET) resin, and the compound was melted at 260° C. through a twin-extruder to form a master batch (M/B) chip (component B).

After that, 4% by weight of IR reflective green pigment was introduced into a hydrophilic nylon (Nylon-6) resin to form a master batch (M/B) chip (component A). Then, the master batch chips were introduced into individual spinning nozzles and under the spinning conditions as described below, they were subjected to offline drawing and heat treatment, thus manufacturing the core-sheath type multi-component spinning fiber. The cross section of the fiber is shown in FIG. 1.

<Spinning Conditions>

Spinning nozzle: core-sheath type spinning nozzle having 36 holes each having a diameter of 1 mm Spinning temperature: 270° C.

Yarn thickness: 30 denier/filament

Spinning speed: 600 m/min

Draw ratio (heat treatment temperature): 3.5 times (120° C.)

Take-up speed: 2,100 m/min

EXAMPLE 2

Manufacturing Sea-island Type Multi-component Spinning Fiber having Two Island Components First, 46% by weight of a hydrophilic nylon (Nylon-6) resin (component A) as a sea component, 25% by weight of a polypropylene (PP) resin (component B) as a first island component, and 25% by weight of a polyethylene terephthalate (PET) resin (component C) as a second island component were melted and subjected to melt conjugated spinning through a sea-island nozzle having 3808 island components under the spinning conditions as described below, thus manufacturing the multi-component spinning fiber having the sea-island type nano fiber in which 200 nm class of 3808 island components were contained. At this time, the pigment components or X-ray absorption materials contained in each polymer material were the same as in Example 1. The cross section of the fiber is shown in FIG. 2.

<Spinning Conditions>

Spinning nozzle: sea-island type spinning nozzle capable of spinning 3808 island components from one hole Spinning temperature: 270° C.

Yarn thickness: 30 denier/filament

Spinning speed: 600 m/min

Draw ratio (heat treatment temperature): 3.5 times (120° C.)

Take-up speed: 2,100 m/min

EXAMPLE 3

Manufacturing Sea-island Type Multi-component Spinning Fiber having Two Side-by-side Type Island Components First, 2% by weight of IR absorption blue pigment was introduced into a polybutylene terephthalate (PBT) resin, and the compound was melted at 240° C. through a twin-extruder to form a master batch (M/B) chip (component A). Next, 20% by weight of barium sulfate was introduced into a polytrimethylene terephthalate (PTT) resin, and the compound was melted at 240° C. through a twin-extruder to form a master batch (M/B) chip (component B). After that, 2% by weight of UV fluorescent yellow-green pigment was introduced into a polytrimethylene terephthalate (PTT) resin, and the compound was melted at 240° C. through a twin-extruder to form a master batch (M/B) chip (component C). Then, 50% by weight of the master batch chips were introduced and melted into extruders having a side-by-side type spinning nozzle, and after that, they were subjected to spinning at a spinning speed of 1,000 m/min and to offline drawing and heat treatment, thus manufacturing the sea-island type multi-component spinning fiber having two side-by-side type island components. The cross section of the fiber is shown in FIG. 3.

EXPERIMENT EXAMPLE

Identification Sensing Performance Evaluation

The core-sheath type multi-component spinning fiber manufactured in Example 1 was irradiated with X-rays through X-rays irradiation equipment (X-EYE SF-160) under measuring conditions (Cu, 60 kv, and 140 μm), thus testing the identification sensing performance.

Further, the change of the colors of the core-sheath type multi-component spinning fiber manufactured in Example 1 were observed before and after the fiber was irradiated with UV rays. As a result, the core-sheath type multi-component spinning fiber did not express any fluorescence before irradiation, but exhibited fluorescence after irradiation.

In addition, when the same multi-component spinning fiber was irradiated with IR rays, the changes of the colors of the multi-component spinning fiber were observed before and after irradiation.

The shape of the outer component A of the core-sheath type multi-component spinning fiber manufactured in Example 1 was observed through the X-rays radiation, thus checking excellent identification sensing performance.

INDUSTRIAL APPLICABILITY

As described above, there is provided the security yarn containing the multi-component spinning fiber that can be identified by infrared and ultraviolet wavelength and also identified by X-ray irradiation.

Further, the security yarn containing the multi-component spinning fiber according to the present invention can be identified by infrared and ultraviolet wavelength and easily identified upon X-ray irradiation. Accordingly, the security yarn has means capable of providing the multi-identification capability, thus being useful for preventing counterfeiting of the products such as paper money, gift certificates, marketable securities, and passports.

Furthermore, the security yarn containing the multi-component spinning fiber according to the present invention can be applied to imitation prevention products such as expensive brand-name bags, shoes and clothes and be usefully applied to military products as identification friend or foe products.

While the present invention has been described with reference to the particular illustrative embodiments, it is not to be restricted by the embodiment but only by the appended claims. It is to be appreciated that those skilled in the art can change or modify the embodiments without departing from the scope and spirit of the present invention.

The invention claimed is:

1. A security yarn containing a multi-component fiber, wherein the multi-component fiber comprises at least three different polymers, a first pigment, wherein the first pigment is an IR reactive pigment or an IR absorption pigment, a second pigment, wherein the second pigment is a visible pigment or an invisible UV-reactive fluorescent pigment, and third material, wherein the third material is a X-ray absorption material, wherein, the multi-component fiber includes at least three different zones in a cross-section of the multi-component fiber, wherein the at least three different polymers include a polymer A, a polymer B, and a polymer C, wherein the polymers are arranged in a A-B-C cross-sectional configuration, wherein, the polymer A located at an outer area of the multi-component fiber comprises a hydrophilic polymer resin or a polyester resin so that the dispersion rate in water is improved upon the paper making process, and the polymer B or C located at a core area of the multi-component fiber comprises polypropylene (PP) having a specific gravity of less than 1 or polyethylene (PE) having a specific gravity of less than 1, wherein at least one of the first pigment, the second pigment, and the third material is dispersed in each of the at least three different polymers such that the multi-component fiber is configured to have a multi-identification capability due to the at least three different zones in the cross-section of the multi-component fiber and by each of the first pigment, the second pigment, and the third material, wherein a weight ratio of the hydrophilic polymer resin or the polyester resin in the polymer A of the multi-component fiber is controlled to provide the multi-component fiber having a specific gravity of more than 1.

2. The security yarn according to claim 1, wherein the multi-component fiber has a circular cross section or have any one modified cross section selected from the group consisting of triangular, rectangular, polygonal, oval, −shaped, Y shaped, +shaped, # shaped and * shaped cross sections.

3. The security yarn according to claim 1, wherein the at least three different polymers are arranged to provide any one of the fibers selected from the group consisting of core-sheath type, sea-island type and side-by-side type fibers.

4. The security yarn according to claim 1, wherein 0.001 to 50% by weight of the first pigment is contained in any one of the at least three different polymers.

5. The security yarn according to claim 1, wherein 0.001 to 50% by weight of the second pigment is contained in any one of the at least three different polymers.

6. The security yarn according to claim 1, wherein the third material is formed of a material having an X-ray shielding function and satisfying a specific gravity in the form of powder of one or more at a room temperature or 300° C.

7. The security yarn according to claim 1, wherein the polymer A comprises at least one hydrophilic polymer resin selected from the group consisting of nylon, polyacrylonitrile, polyacrylic acid, polyacrylate, polymethyl methacrylate, polyethylene amide, cellulos acetate, cellulose triacetate, polyvinyl alcohol, polyvinylpyrrolidone, polyethylene glycol, sulfonated polysulfone, polyethylene oxide and polyvinyl acetate or at least one polyester resin selected from the group consisting of polyethylene terephthalate, polybutylene terephthalate, polytrimethylene terephthalate and polyethylene naphthalate.

8. The security yarn according to claim 1, wherein the polymer B or C comprises a polymer resin-selected from the group consisting of polypropylene, polyethylene, polyethylene terephthalate, polyethylene naphthalate, polystyrene, polycarbonate, polymethyl methacrylate, polyether sulfone, polyvinylidene fluoride, polyether ketone, polyphenylene sulfide and aromatic polyester.

9. A counterfeit money prevention product applied to any one of paper money, gift certificates, marketable securities, and passports through a paper making process processed mixedly with security yarn containing a multi-component fiber having a multi-identification capability as claimed in claim 1.

10. An imitation prevention product applied to any one of bags, shoes and clothes comprising security yarn having a multi-component fiber having a multi-identification capability as claimed in claim 1.

11. A military identification friend or foe product applied to any one of military products using security yarn containing a multi-component fiber having a multi-identification capability as claimed in claim 1.

* * * * *